US007182615B1

(12) United States Patent
Liu

(10) Patent No.: US 7,182,615 B1
(45) Date of Patent: Feb. 27, 2007

(54) ELECTRIC SOCKET HAVING MEANS TO LOCK THE BLADES OF INSERTED ELECTRIC PLUG

(75) Inventor: Wei-Ho Liu, Tucheng (TW)

(73) Assignee: Ta Hsing Electric Wire & Cable Co., Ltd., Taipei (TW)

( * ) Notice: Subject to any disclaimer, the term of this patent is extended or adjusted under 35 U.S.C. 154(b) by 0 days.

(21) Appl. No.: 11/350,816

(22) Filed: Feb. 10, 2006

(51) Int. Cl.
*H01R 13/62* (2006.01)
*H01R 13/15* (2006.01)

(52) U.S. Cl. ..... 439/263; 439/346

(58) Field of Classification Search ..... 439/263, 439/261, 346
See application file for complete search history.

(56) References Cited

U.S. PATENT DOCUMENTS 6,428,339 B1 * 8/2002 Davidson et al. ..... 439/346
6,676,428 B2 * 1/2004 Burton ..... 439/270

* cited by examiner

*Primary Examiner*—Javaid H. Nasri
(74) *Attorney, Agent, or Firm*—Ming Chow; Sinorica, LLC

(57) ABSTRACT

An electric socket is disclosed to include a housing provided at one end of a cable and having insertion slots for the insertion of the metal electrodes of an electric plug, a socket body mounted inside the housing and holding two metal electrode clamps on the inside for receiving the metal electrodes of an electric plug, a holding down structure provided inside the socket body, and a rotating ring mounted on the socket body and exposed to the outside of the housing and rotatable between a first position to force the holding down structure against the metal electrode clamps and to further lock the metal electrodes of the inserted electric plug and a second position to release the holding down structure from the metal electrode clamps.

4 Claims, 7 Drawing Sheets

ELECTRIC SOCKET HAVING MEANS TO LOCK THE BLADES OF INSERTED ELECTRIC PLUG

BACKGROUND OF THE INVENTION

1. Field of the Invention

The present invention relates to an electric socket and more particularly, to a safety electric socket, which has means to lock the blades (electrodes) of the inserted electric plug.

2. Description of the Related Art

An extension cable may be used to extend power supply from a wall outlet to a suitable location for the connection of the electric plug of an electric appliance. Frequently plugging the electric plug into the electric socket of the extension cable and deplugging the electric plug from the electric socket may cause loosening of the metal clamping plates of the electric socket or the metal blades of the electric plug. Loosening of the metal clamping plates of the electric socket or the metal blades of the electric plug may result in power failure of the electric appliance or a short circuit.

FIGS. 1 and 2 show an electric socket constructed according to Taiwan Patent Publication No. M261875, entitled "Electric Socket Locking Device", which comprises a housing 91, a socket body 92, and a locking device 93. Rotating the rotary knob 931 of the locking device 93 to force its bottom protruding portion 9314 against the top protrusion 9323 of a pressure block 932, the pair of protrusions of a locking member 933 are moved with the locking member 933 over a protrusion 9324 of the pressure block 932 into a respective groove 9332 at the bottom side of the pressure block 932 for allowing downward movement of the pressure block 932, and therefore the clamping holes 9326 of the clamping feet 9325 of the pressure block 932 are forced into engagement with the metal blades 961 of the inserted electric plug, locking the inserted electric plug to the electric socket. On the contrary, rotating the rotary knob 931 of the locking device 93 in the reversed direction, the pair of protrusions of the locking member 933 are moved with the locking member 933 out of the respective grooves 9332 of the pressure block 932 over the a protrusion 9324 of the pressure block 932 to force the pressure block 932 upwards, thereby unlocking the inserted electric plug. According to this design, the rotary knob 931 of the locking device 93 protrudes over the top side of the housing 91 at a distance, increasing space occupation of the electric socket and destructing the sense of beauty.

SUMMARY OF THE INVENTION

The present invention has been accomplished under the circumstances in view. It is one object of the present invention to provide an electric socket, which has means to lock the metal blades (electrodes) of the inserted electric plug, preventing a short circuit. It is another object of the present invention to provide an electric socket having means to lock the metal blades (electrodes) of the inserted electric plug, which has a compact size and nice outer looking.

To achieve these and other objects of the present invention, the electric socket comprises a housing formed of a holder shell and a front cover, the front cover having two insertion slots for receiving the metal blades (electrodes) of an electric plug, the holder shell being fixedly provided at one end of a cable, a socket body, which is mounted in the housing and has mounted therein two metal electrode clamps, holding down means provided inside said socket body, and a rotating ring rotatably mounted on the socket body and exposed to the outside of the housing.

The rotating ring is rotatable between a locking position where the rotating ring forces the holding down means against the metal electrode clamps to hold down the metal blades (electrodes) of the inserted electric plug, and an unlocking position where the rotating ring is released from the holding down means for allowing disconnection of the metal blades of the inserted electric plug from the metal electrode clamps.

DETAILED DESCRIPTION OF THE PREFERRED EMBODIMENT

Figure 1:
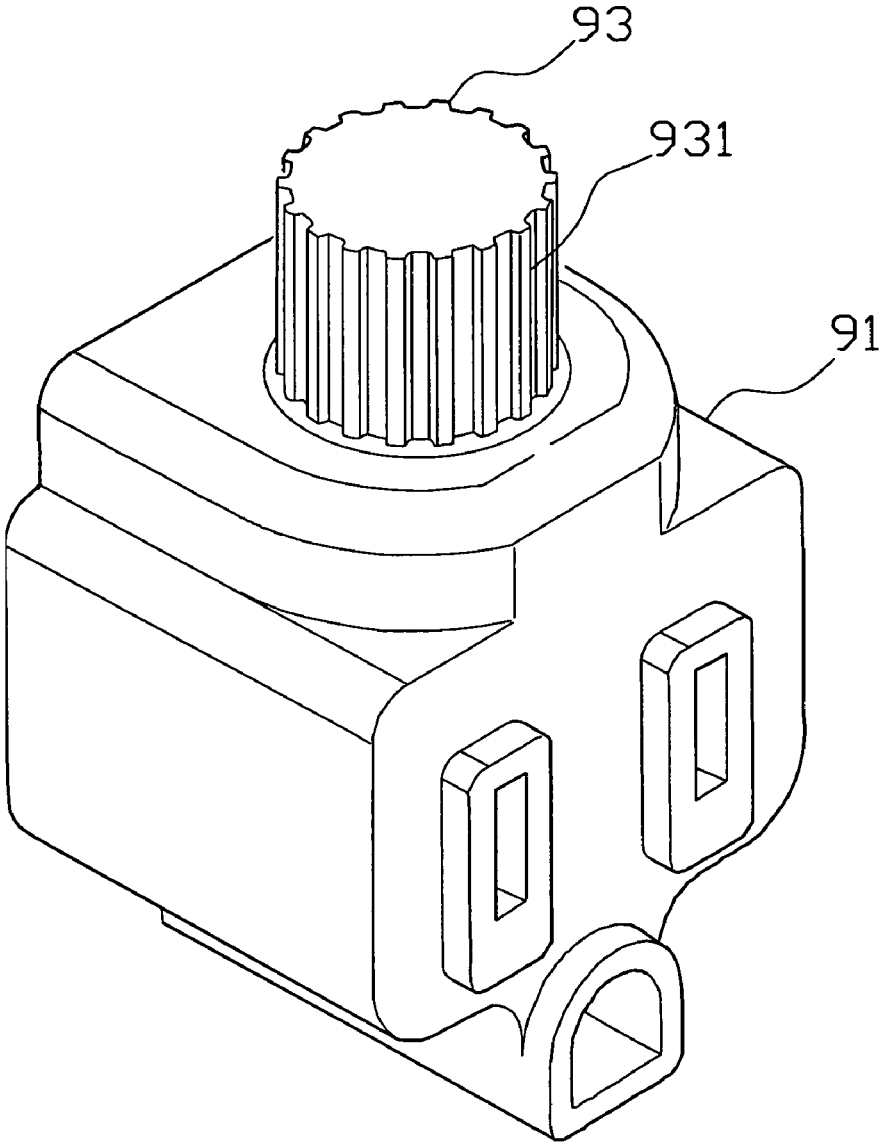
FIG. 1 PRIOR ART
FIG. 1 is an elevational view of an electric socket according to the prior art.
Figure 2:
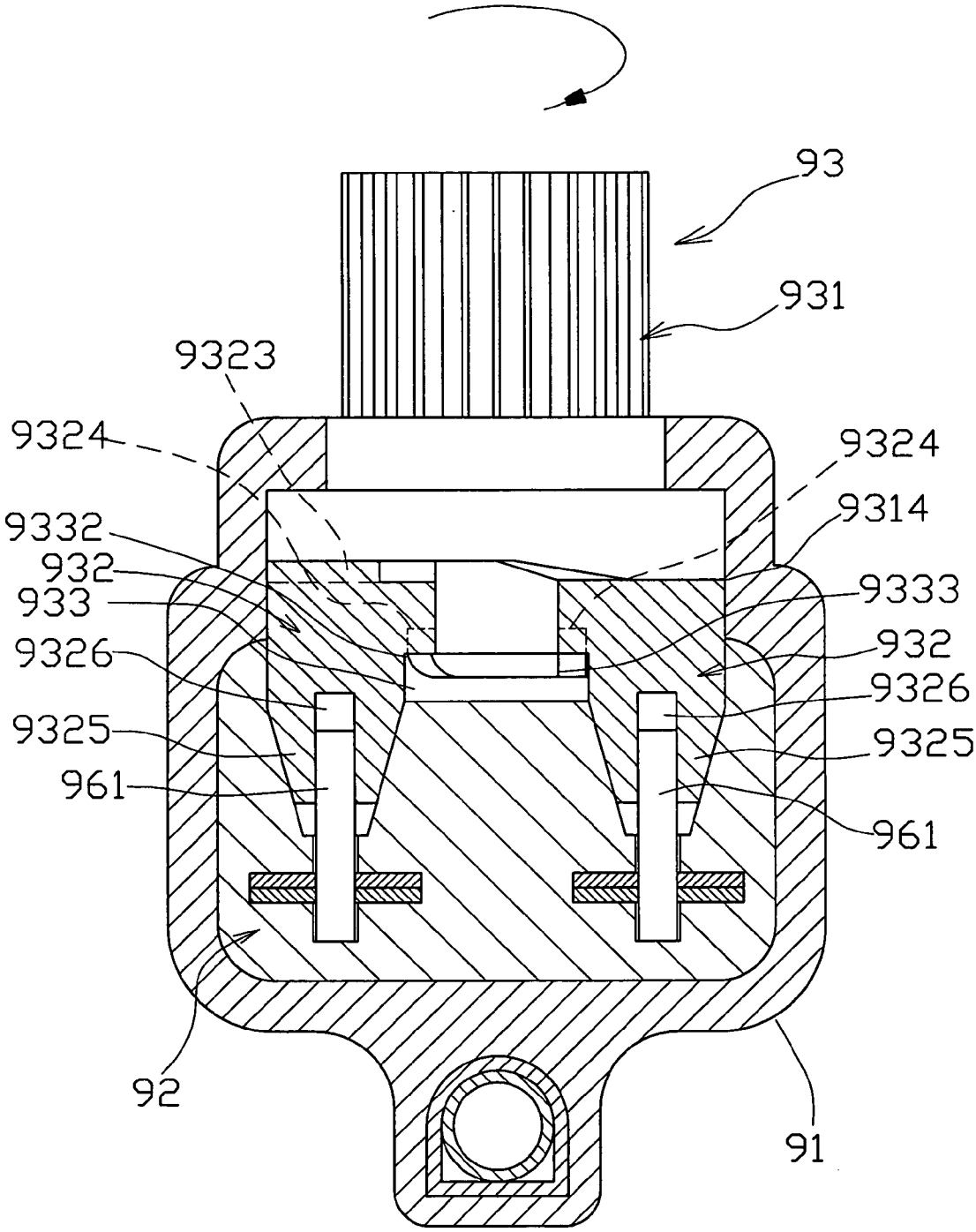
FIG. 2 PRIOR ART
FIG. 2 is a sectional view in an enlarged scale of the electric socket shown in FIG. 1.
Figure 3:
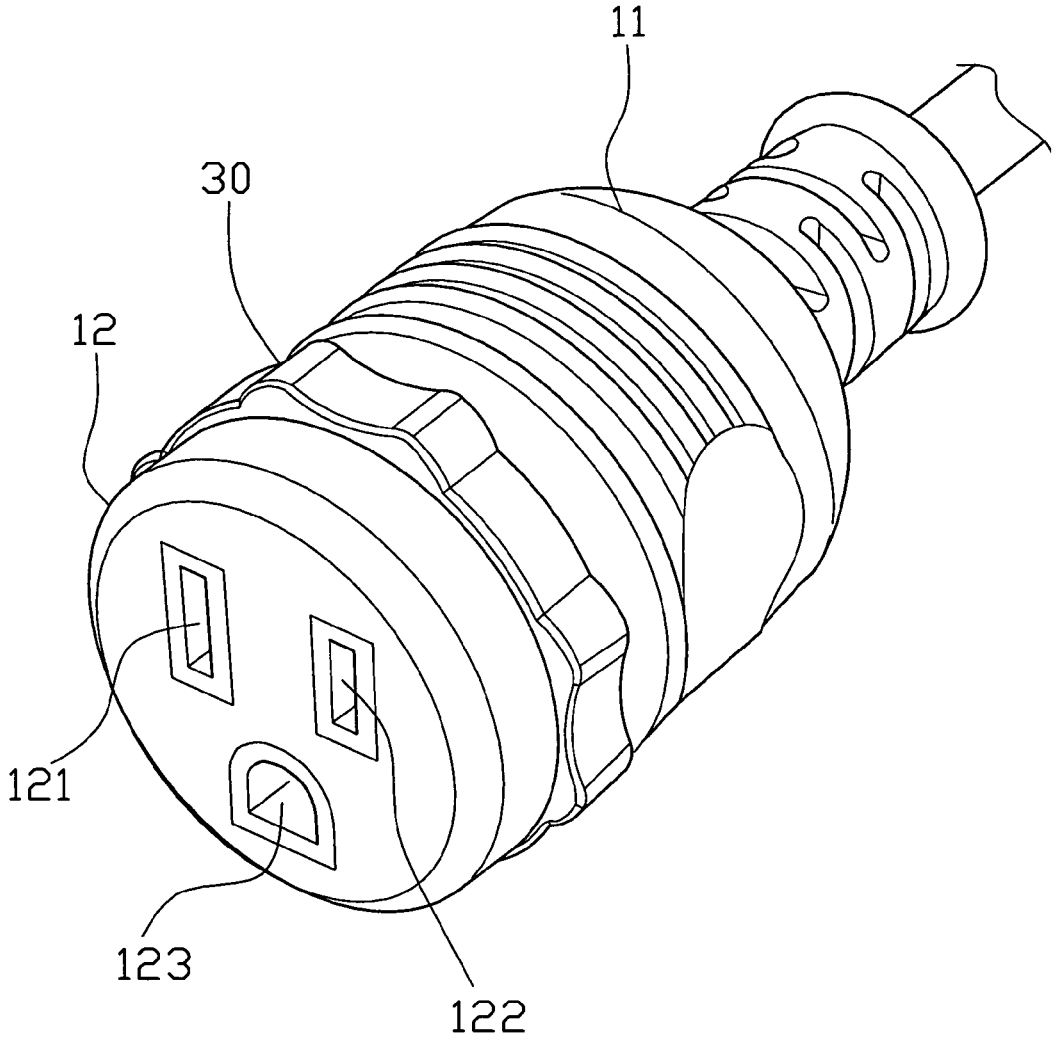
FIG. 3 is an elevational view of an electric socket according to the present invention.
Figure 4:
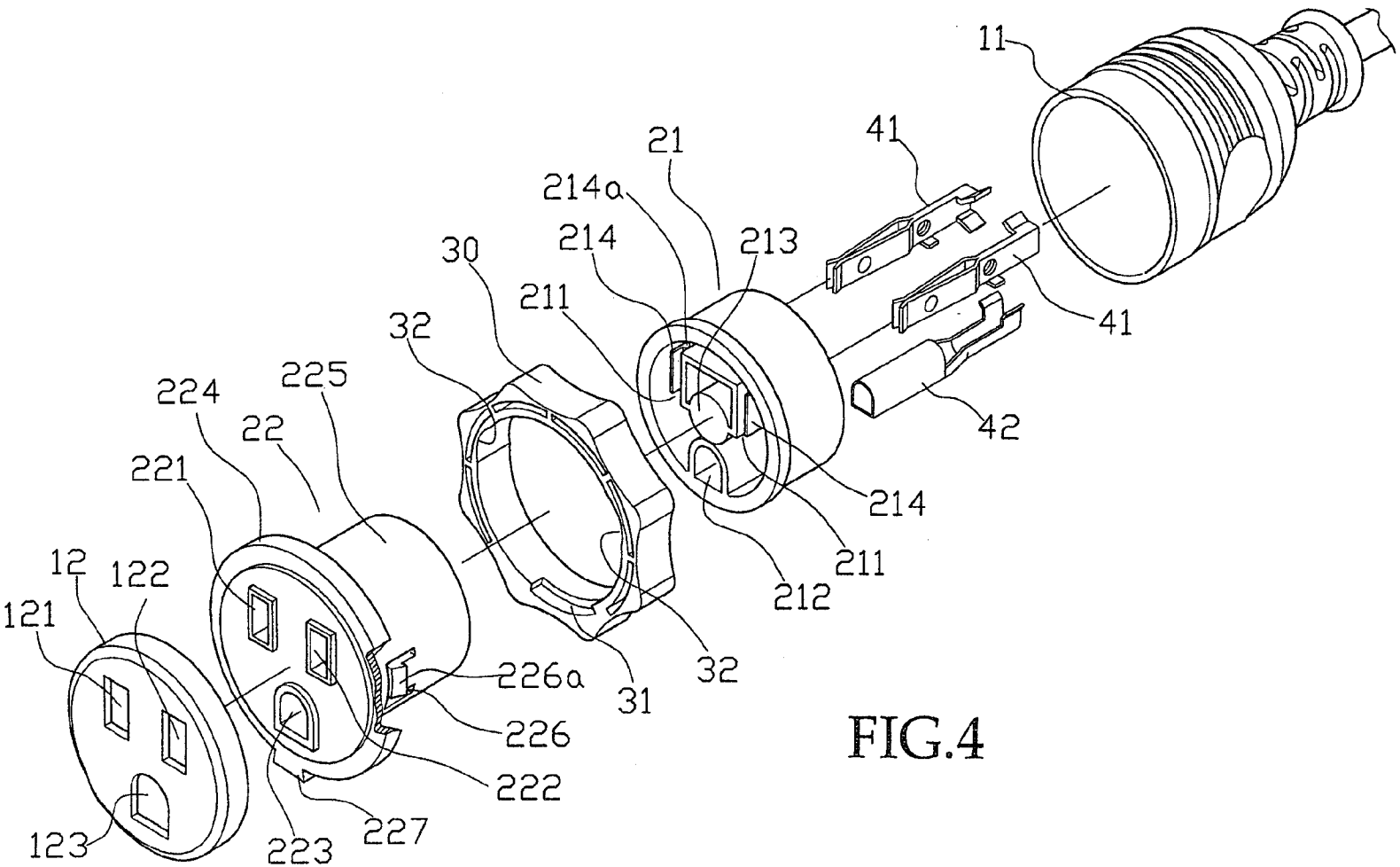
FIG. 4 is an exploded view of the electric socket according to the present invention.
Figure 5:
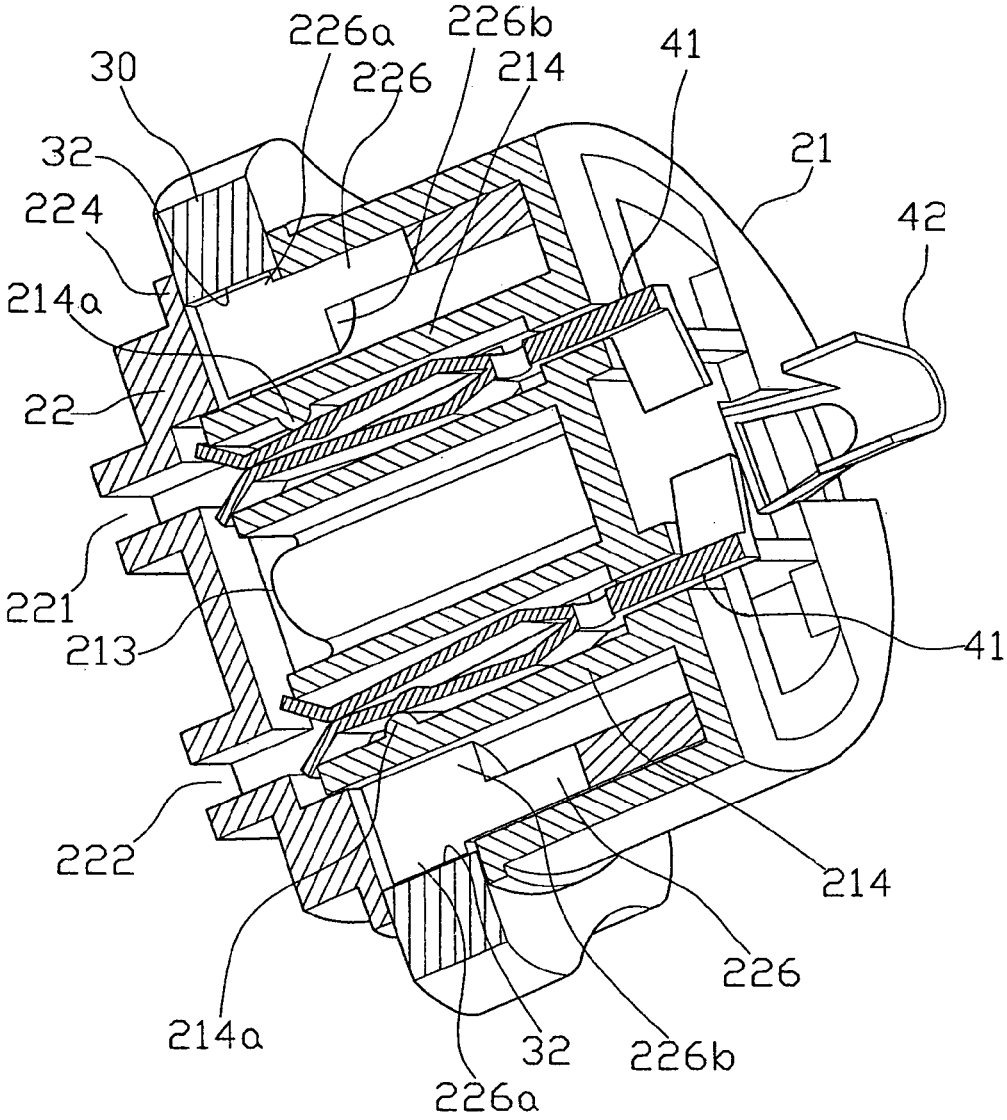
FIG. 5 is a sectional elevation of a part of the present invention, showing the internal arrangement of the electric socket.
Figure 6:
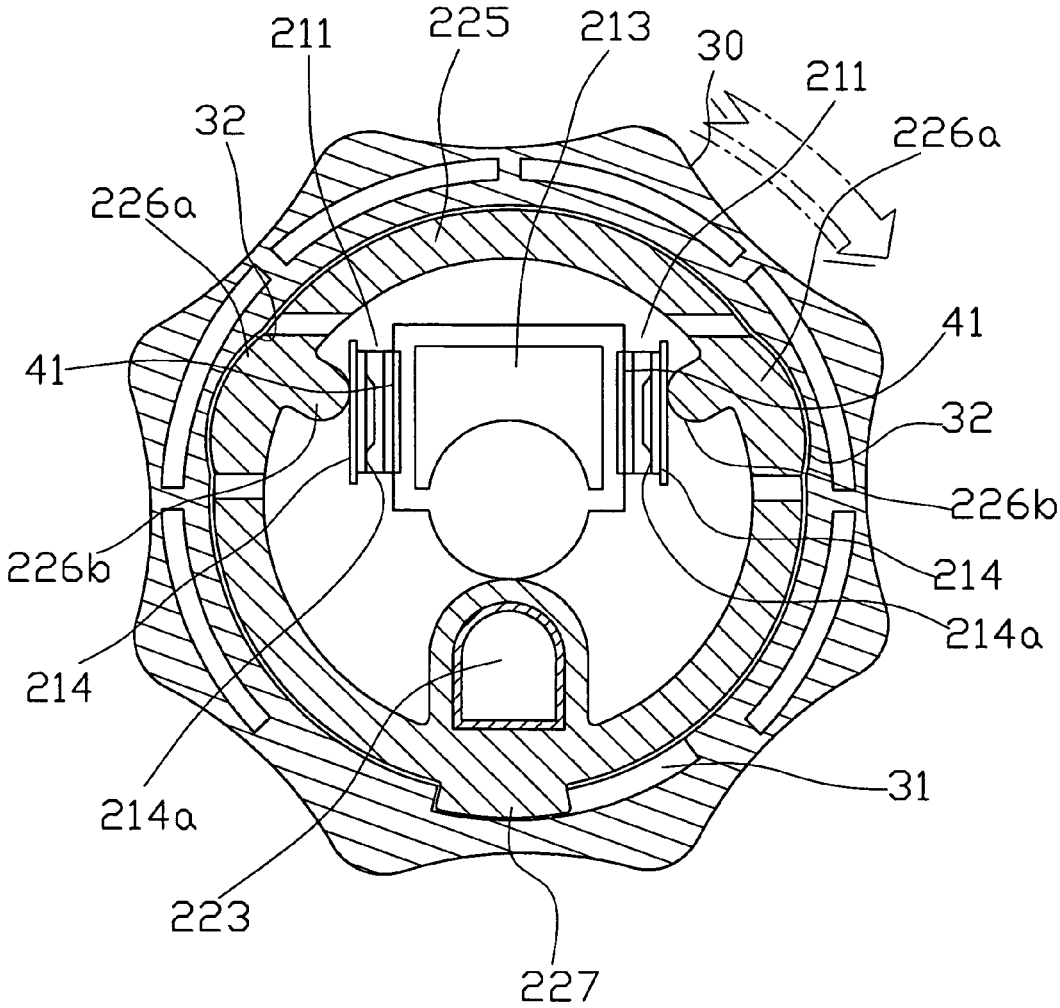
FIG. 6 is a schematic sectional plain view of the electric socket according to the present invention.

Referring to FIGS. 3~7, an electric socket in accordance with the present invention is used in a socket type extension cable, comprised of a holder shell 11, a front cover 12, a rear socket body 21, a front socket body 22, a rotating member 30, two metal electrode clamps 41, and a metal grounding clamp 42.

The holder shell 11 is fixedly provided at one end of the extension cable and adapted to accommodate the rear socket body 21.

The front cover 12 has a plurality insertion slots 121,122, 123 cut through the front and rear sides for receiving the metal blades and grounding prong of an electric plug (not shown).

The front socket body 22 comprises a hollow cylindrical base 225 inserted into the rear socket body 21, a head 224 formed integral with one end of the cylindrical base 225 and stopped outside the rear socket body 21 and covered by the front cap 12, a plurality of insertion slots 221,222,223 cut through the head 224 corresponding to the insertion slots 121,122,123 of the front cover 12, two retaining spring strips 226 respectively formed integral with and cut from the peripheral wall of the cylindrical base 225 and respectively terminating in a respective inwardly extending protruding portion 226*b* and an outwardly extending protruding portion 226*a* (see FIG. 7), and a guide block 227 outwardly protruding from the connection between the cylindrical base 225 and the head 224.

Figure 7:
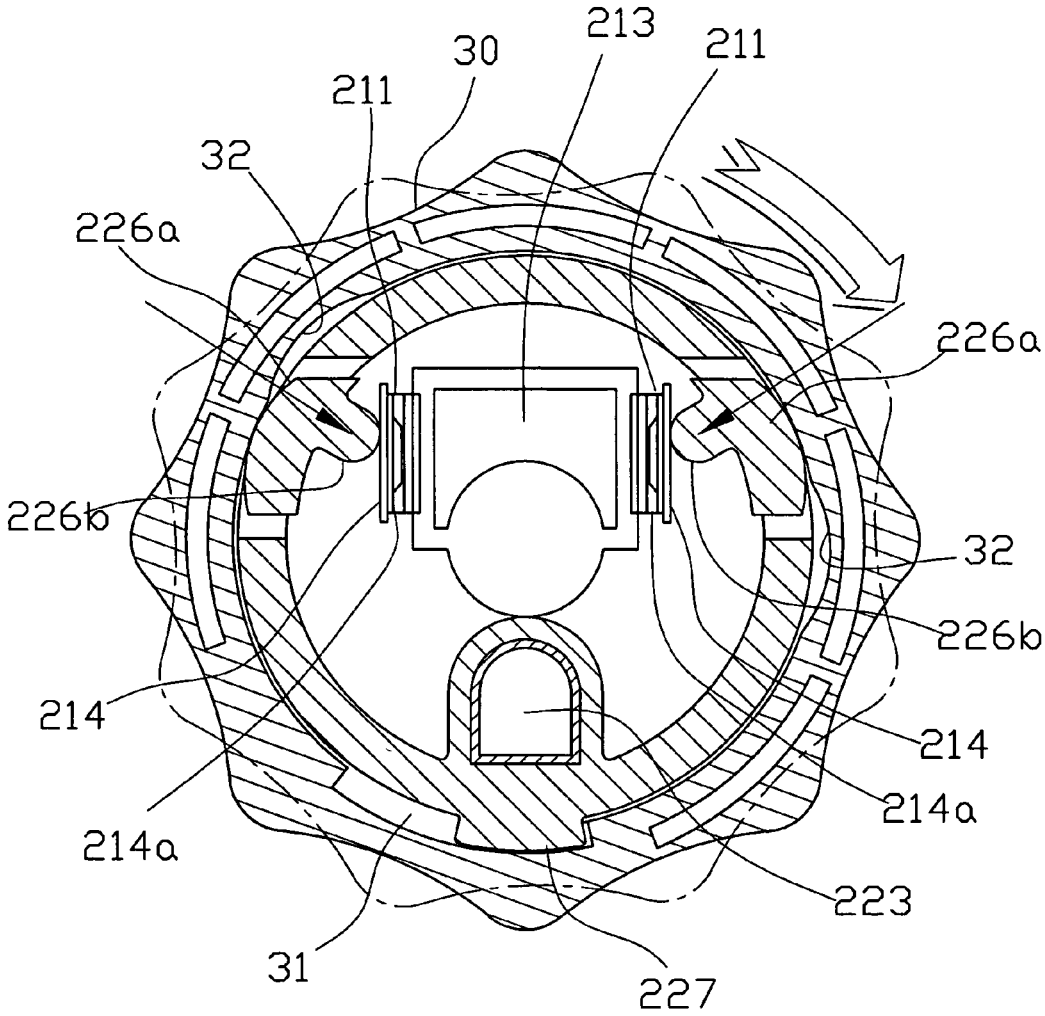
FIG. 7 is similar to FIG. 6 but showing the movable blocks pressed at the respective metal electrode clamps against the fixed block.

The rotating ring 30 is axially movably sleeved onto the cylindrical body 225 of the front socket body 22 and rotatably supported between the head 224 of the front socket body 22 and the rear socket body 21, having an inside guide groove 31 coupled to the guide block 227 of the front socket body 22 to guide rotation of the rotating ring 30 relative to the front socket body 22 and to limit the angle of rotation of the rotating ring 30 relative to the front socket body 22, and two inside actuating grooves 32 respectively coupled to the outwardly extending protruding portions 226*a* of the two retaining spring strips 226 of the front socket body 22 for forcing the inwardly extending protruding portions 226*b* of the two retaining spring strips 226 of the front socket body 22 toward the inside of the front socket body 22 (see FIG. 7).

The rear socket body 21 is inserted into the holder shell 11, comprising two axially extending electrode clamp slots 211, which accommodates the two metal electrode clamps 41 respectively, an axially extending grounding clamp slot 212, which accommodates the metal grounding clamp 42. Further, the rear socket body 21 has a fixed block 213 of a substantially ⊓-shaped cross section disposed on the inside on the middle, and two movable blocks 214 disposed at two sides relative to the fixed block 213 and defining with the fixed block 213 the aforesaid electrode clamp slots 211. The movable blocks 214 are respectively disposed in contact with the outwardly extending protruding portions 226*a* of the two retaining spring strips 226 of the front socket body 22, each having an inner rib 214*a* disposed in contact with the associating metal electrode clamp 41.

Referring to FIGS. 6 and 7 again, after insertion of the metal blades and grounding prong of an electric plug (not shown) into the plurality insertion slots 121,122,123 of the front cap 12 and the insertion slots 221,222,223 of the front socket body 22 into the metal electrode clamps 41 and the metal grounding clamp 42, the user can rotate the rotating ring 30 in the direction indicated by the arrowhead sign in FIG. 6 to the position shown in FIG. 7 where the retaining spring strips 226 of the front socket body 22 are squeezed inwards to force the inwardly extending protruding portions 226*b* against the movable blocks 214 and to further force the inner ribs 214*a* against the metal electrode clamps 41, causing the metal electrode clamps 41 to hold down the metal blades of the inserted electric plug firmly. When rotated the rotating ring 30 in the reversed direction, the metal electrode clamps 41 are released from the movable blocks 214.

Because the rotating ring 30 is axially movably sleeved onto the cylindrical body 225 of the front socket body 22 and rotatably supported between the head 224 of the front socket body 22 and the rear socket body 21, it does not increase much the size of the electric socket. Further, the use of the rotating ring 30 does not destruct the sense of beauty of the electric socket.

Although a particular embodiment of the invention has been described in detail for purposes of illustration, various modifications and enhancements may be made without departing from the spirit and scope of the invention. Accordingly, the invention is not to be limited except as by the appended claims.

The invention claimed is:

1. An electric socket comprising:

a housing formed of a holder shell and a front cover, said front cover having two insertion slots for receiving the metal blades of an electric plug, said holder shell being fixedly provided at one end of a cable;

a socket body accommodated in said housing, said socket body having mounted therein two metal electrode clamps;

holding down means provided inside said socket body; and a rotating ring rotatably mounted on said socket body and exposed to the outside of said housing;

wherein said rotating ring is rotatable between a locking position where said rotating ring forces said holding down means against said metal electrode clamps to hold down the metal blades of the inserted electric plug, and an unlocking position where said rotating ring is released from said holding down means for allowing disconnection of the metal blades of the inserted electric plug from said metal electrode clamps;

wherein said socket body is comprised of a front socket body and a rear socket body, said front socket body comprising a hollow cylindrical base inserted through said rotating ring into said rear socket, a head disposed at one end of said hollow cylindrical base and stopped outside said rear socket body and said rotating ring, two insertion slots cut through front and rear sides of said head corresponding to the insertion slots of said front cover, said rear socket body comprising a plurality of electrode clamp slots for accommodating said metal electrode clamps.

2. The electric socket as claimed in claim 1, wherein said holding down means comprises a fixed block disposed inside said rear socket body, said fixed block having two opposite lateral sides respectively supporting said metal electrode clamps at an inner side, and two movable blocks disposed inside said rear socket body at two sides relative to said fixed block and respectively disposed in contact with said metal electrode clamps at an outer side, said movable blocks each having an inner rib respectively disposed in contact with said movable blocks; said front socket body comprises two retaining spring strips, said retaining spring strips each having an inwardly extending protruding portion respectively disposed in contact with said metal electrode clamps and an outwardly extending protruding portion respectively disposed in contact with said rotating ring; said rotating ring comprises two inside actuating grooves adapted to receive the outwardly extending protruding portions of the retaining spring strips of said holding down means and to force said retaining spring strips against said movable blocks and said metal electrode clamps after a rotary motion of said rotating ring relative to said socket body through a predetermined angle.

3. The electric socket as claimed in claim 1, wherein said front socket body has a guide block protruded from said head; said rotating ring has an inside guide groove coupled to said guide block of said front socket body for guiding rotation of said rotating ring relative to said socket body and limiting the angle of rotation of said rotating ring relative to said socket body.

4. The electric socket as claimed in claim 1, wherein said front cover of said housing further has a grounding prong insertion slot for the insertion of the grounding prong of an electric plug; said front socket further has a grounding clamp slot accommodating a metal grounding clamp and aimed at the grounding prong insertion slot of said front cover.

* * * * *